US011648781B2

(12) United States Patent
Van Der Gucht et al.

(10) Patent No.: US 11,648,781 B2
(45) Date of Patent: May 16, 2023

(54) PRINTING SYSTEM AND METHOD WITH EFFICIENT MEMORY USAGE

(71) Applicant: XEIKON MANUFACTURING N.V., Lier (BE)

(72) Inventors: Romain Jan Victor Paul Van Der Gucht, Lint (BE); Marc Lodewijk Cornelia Goetschalckx, Lint (BE); Nathan Anny Omaar Catharina Didier Van De Velde, Wommelgem (BE)

(73) Assignee: XEIKON MANUFACTURING N.V., Lier (BE)

( * ) Notice: Subject to any disclaimer, the term of this patent is extended or adjusted under 35 U.S.C. 154(b) by 260 days.

(21) Appl. No.: 16/979,680

(22) PCT Filed: Mar. 20, 2019

(86) PCT No.: PCT/EP2019/056972
§ 371 (c)(1),
(2) Date: Sep. 10, 2020

(87) PCT Pub. No.: WO2019/180086
PCT Pub. Date: Sep. 26, 2019

(65) Prior Publication Data

US 2021/0046765 A1 Feb. 18, 2021

(30) Foreign Application Priority Data

Mar. 22, 2018 (NL) ..... 2020646

(51) Int. Cl.
*B41J 2/21* (2006.01)
*B41J 2/155* (2006.01)

(52) U.S. Cl.
CPC ..... *B41J 2/2146* (2013.01); *B41J 2/155* (2013.01)

(58) Field of Classification Search
CPC .... B41J 2/04543; B41J 2/2135; B41J 2/2132; B41J 2/155; B41J 2/2146; B41J 2/04573; B41J 2202/20; B41J 29/38
See application file for complete search history.

(56) References Cited

U.S. PATENT DOCUMENTS

| | | | |
|---|---|---|---|
| 5,619,622 | A | 4/1997 | Audi et al. |
| 2003/0072036 | A1 | 4/2003 | Silverbrook et al. |
| 2011/0254889 | A1 | 10/2011 | Miller et al. |

FOREIGN PATENT DOCUMENTS

| | | | |
|---|---|---|---|
| JP | 2004237599 | A2 | 8/2004 |
| JP | 2010006066 | A2 | 1/2010 |

(Continued)

OTHER PUBLICATIONS

International Search Report and Written Opinion, PCT Application No. PCT/EP2019/056972, dated May 24, 2019, 9 pages.

*Primary Examiner* — Jannelle M Lebron
(74) *Attorney, Agent, or Firm* — KDW Firm PLLC

(57) ABSTRACT

A method for printing a plurality of scan lines with one or more inkjet heads includes receiving at least one scanline; creating, from pixels of said at least one scanline, a plurality of bundles of a predetermined size comprising first bundles and consecutive bundles, said first and consecutive bundles comprising pixels for which nozzles of the one or more inkjet heads have to be fired within a first time period and within a consecutive time period, respectively; and storing said plurality of bundles in a first memory. The method includes transferring said plurality of bundles from first memory to second memory; and repeating until all said pixels are available in the second memory as the first bundles. Nozzles of the one or more inkjet heads are fired in accordance with the first bundles within the first time period and steps repeated for consecutive bundles and associated respective consecutive time periods.

20 Claims, 6 Drawing Sheets

(56) References Cited

FOREIGN PATENT DOCUMENTS

| | | | |
|---|---|---|---|
| JP | 2014019046 | A2 | 2/2014 |
| JP | 2016068462 | A2 | 5/2016 |

PRINTING SYSTEM AND METHOD WITH EFFICIENT MEMORY USAGE

This is a national stage application filed under 35 U.S.C. § 371 of pending international application PCT/EP2019/056972, filed Mar. 20, 2019, which claims priority to Netherlands Patent Application No. NL 2020646, filed Mar. 22, 2018, the entirety of which applications are hereby incorporated by reference herein.

FIELD OF INVENTION

The field of the invention relates to printing systems and methods using one or more inkjet heads and in particular to a printing method and apparatus with improved memory usage.

BACKGROUND

An ink-jet printer records an image on a recording medium by discharging an ink from nozzles formed on one or more inkjet heads. A substrate is transported below the one or more inkjet heads with a predetermined speed.

The number of nozzles required across the printing direction is primarily defined by the desired print resolution relative to the given print resolution of the inkjet printing head used. Since a nozzle has minimum dimensions the distance between two adjacent nozzles cannot be infinitely decreased. For that reason an inkjet head preferably comprises a plurality of rows of nozzles which are shifted with respect to each other in order to increase the printing resolution.

An example of a known inkjet head comprises a plurality of rows n, e.g. 16 rows, each having a plurality of nozzles m, e.g. between 100 and 200 nozzles, wherein the rows are oriented in a direction perpendicular to the printing direction, i.e. in the direction in which the substrate moves with respect to the inkjet head. It is noted that one inkjet head may comprise a plurality of chips or dies which are put together to form the plurality of rows. Also, each row may have the same amount of nozzles or some rows may have a different amount of nozzles. Due to physical limitations, typically the rows are separated by more than one scanline, e.g. k scanlines where k may be e.g. between 10 and 30 scanlines. In typical known embodiments, the nozzles of the inkjet head may be fired substantially simultaneously. The firing frequency is such that each time the substrate has moved from one row to the next row a firing of all nozzles of the inkjet head is performed k times. The rows are shifted with respect to each other such that the combination of dots printed during subsequent steps of the printing process form a regular pattern. More in particular, when the inkjet head has fired all (n×m) nozzles k times while the substrate moves below the inkjet head, one line of the n lines extending perpendicular on the printing direction will be finished, and may comprise (n×m) dots. In other implementations, the nozzles of the inkjet head may be fired at different moments in time as disclosed in Dutch patent application No. 2020081 in the name of the applicant.

Another example of a known inkjet head comprises an array of a plurality of rows (n) and columns (m), e.g. 32 rows (n=32), each having a plurality of nozzles, e.g. 64 nozzles (m=64), wherein the rows are oriented under a small angle with respect to a direction perpendicular to the printing direction, and the columns are oriented under a small angle with respect to the printing direction. Seen in a direction perpendicular to the printing direction, a plurality of such heads may be provided next to each other. During printing all (n×m) nozzles are fired substantially simultaneously with a firing frequency which is such that the nozzles fire at least every time the substrate has moved to the next row. Also using such an inkjet head, the distance between adjacent printed dots, seen in the printing direction, may be a factor smaller than the distance between adjacent nozzle rows. By increasing the number of rows and columns, the resolution in the printing direction may be increased.

A problem with the known inkjet heads is that large amounts of data corresponding with thousands of scanlines need to be stored. This is typically implemented using software in combination with a large memory, resulting in a relatively expensive system.

SUMMARY

The object of embodiments of the invention is to provide a method and system for printing a plurality of scanlines with one or more inkjet heads that allows an improved memory usage resulting in a more cost-efficient printing method and system.

According to a first aspect of the invention the method for printing a plurality of scanlines with one or more inkjet heads comprises:

a. receiving at least one scanline of the plurality of scanlines;

b. creating, from pixels of said at least one scanline, a plurality of bundles of a predetermined size, such that said plurality of bundles comprises first bundles and consecutive bundles, said first bundles and said consecutive bundles comprising pixels for which nozzles of the one or more inkjet heads have to be fired within a first time period and within a consecutive time period, respectively; and storing said plurality of bundles in a first memory; wherein the predetermined size of a bundle of the plurality of bundles is chosen in function of a second memory;

c. transferring said plurality of bundles from the first memory to the second memory;

d. repeating steps a-c until all pixels for which nozzles of the one or more inkjet heads have to be fired within the first time period are available in the second memory as the first bundles;

e. firing nozzles of the one or more inkjet heads in accordance with the first bundles within the first time period;

f. repeating steps d and e for consecutive bundles and associated respective consecutive time periods.

Using the steps described above, it is possible to have a relatively small first memory and a larger second memory. Further, by choosing the size of the bundles to be appropriate for the second memory, and in particular to be appropriate for obtaining a fast reading/writing data rate, a fast and efficient use of storage is realized. Further, by grouping pixels to be fired within a same time period in suitably sized bundles, a group of bundles to be fired within a particular time period can be read out of the second memory in a fast manner resulting in a fast printing process which makes efficient use of a memory.

Preferably, the second memory comprises a dynamic random access memory, more preferably a synchronous dynamic random access memory (SDRAM), more preferably DDR3. Such memories are suitable for storing the required amount of bundles, and can be read and written in a sufficiently fast manner when suitably sized bundles are used.

Preferably, the predetermined size of a bundle of the plurality of bundles is between 50% and 100% of an optimal size for writing and reading the second memory. For example, for DDR3, the optimal packet size is 512 bits, which corresponds with 128 pixels when each pixel is represented by four bits. In such embodiments, each bundle preferably comprises between 64 and 128 pixels. However, a suitable number of pixels per bundle will also depend on the arrangement and the number of the nozzles in the one or more inkjet heads, and typically a value lower than 128 pixels will be used. In other embodiments each pixel may be represented by 2 bits or 1 bit, wherein more than 128 pixels may be grouped in a bundle.

Preferably, the first memory is at least ten times smaller than the second memory, more preferably at least 100 times smaller than the second memory. Preferably, the first memory stores less than 10 scanlines, more preferably less than 5 scanlines, and the second memory stores at least 1000 scanlines, preferably at least 2000 scanlines. The scanlines may be received on a scanline per scanline basis from a file or data stream, and next grouped in bundles and transferred to the second memory, so that the first memory can be small. However, it is also possible to receive a couple of scanlines in parallel, but even in such a configuration the first memory can store less than 10 scanlines.

According to a possible embodiment, the first memory is included in a programmable hardware component, preferably a field-programmable gate array (FPGA). The first memory may also be included in an application specific integrated circuit (ASIC). According to another possible embodiment the first memory is a cache memory of a central processing unit (CPU).

Other preferred embodiments are disclosed in the attached dependent claims.

According to a second aspect of the invention, there is provided a printing system for printing a plurality of scanlines, said system comprising one or more inkjet heads; a logic unit with a first memory and a second memory. The logic unit is configured for receiving at least one scanline, for creating, from pixels of said at least one scanline, a plurality of bundles of a predetermined size, such that said plurality of bundles comprises first bundles and consecutive bundles, said first bundles and said consecutive bundles comprising pixels for which nozzles of the one or more inkjet heads have to be fired within a first time period and within a consecutive time period, respectively, for storing said plurality of bundles in the first memory, and for transferring said plurality of bundles from the first memory to the second memory. The second memory is configured for storing bundles of consecutive scanlines, until at least all pixels for which nozzles of the one or more inkjet heads have to be fired within the first time period are available in the second memory. The predetermined size of a bundle of the plurality of bundles is chosen to be appropriate for the second memory. The printing system is configured for firing nozzles of the one or more inkjet heads in accordance with the first bundles within the first time period by reading the first bundles out of the second memory; and in accordance with consecutive bundles within the associated consecutive time period by reading the consecutive bundles out of the second memory.

Preferred embodiments of the printing system are disclosed in the dependent claims.

The features and advantages set out above for embodiments of the method, apply mutatis mutandis for embodiments of the printing system.

BRIEF DESCRIPTION OF THE FIGURES

The accompanying drawings are used to illustrate presently preferred non-limiting exemplary embodiments of devices of the present invention. The above and other advantages of the features and objects of the invention will become more apparent and the invention will be better understood from the following detailed description when read in conjunction with the accompanying drawings, in which.

DESCRIPTION OF EMBODIMENTS

Figure 1:
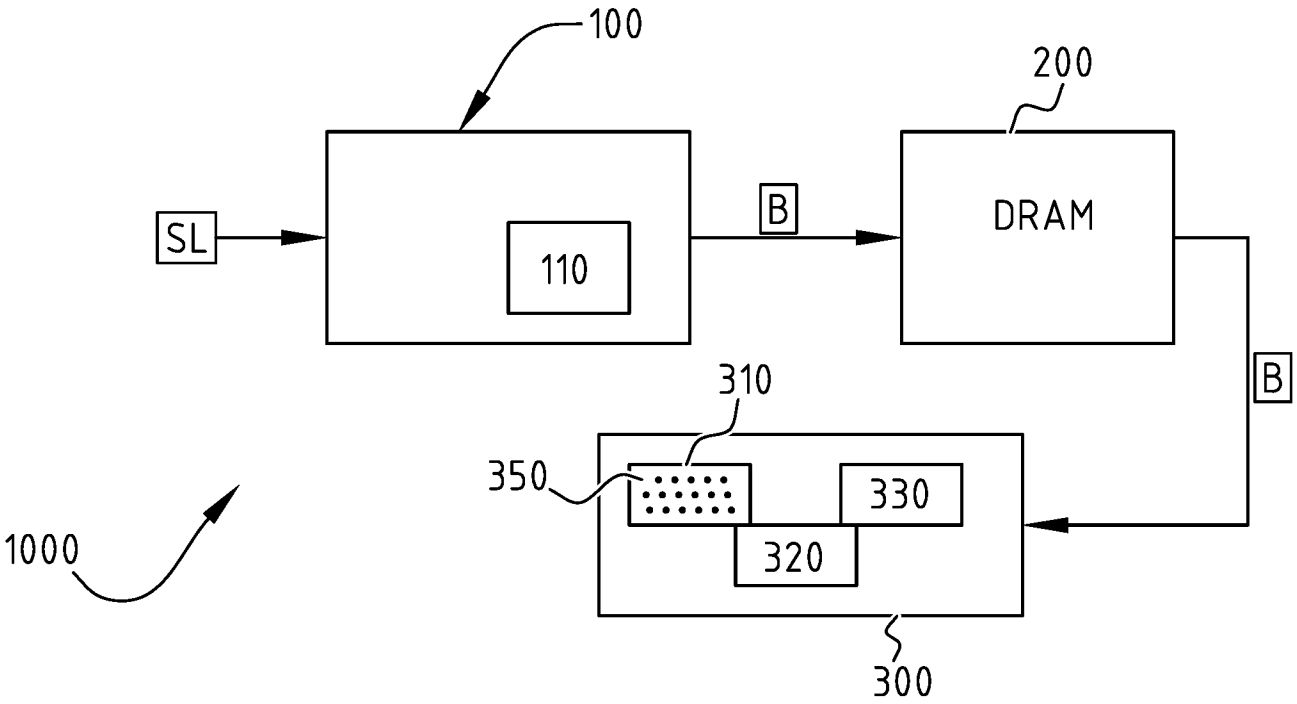
FIG. 1 illustrates schematically an exemplary embodiment of a printing system.

FIG. 1 illustrates an exemplary embodiment of a printing system 1000 for printing a plurality of scanlines SL. The printing system 1000 comprises a logic unit 100 with a first memory 110, a second memory 200 in the form of a DRAM, and an inkjet device 300 consisting of three inkjet heads 310, 320, 330.

The logic unit 100 is configured for receiving at least one scanline SL. In a possible embodiment, one scanline at a time is received, or, stated differently, consecutive scanlines are received in a serial manner by the logic unit 100. However, in other embodiments it may be envisaged to receive two or three consecutive scanlines in parallel at the logic unit 100. The logic unit 100 is further configured for creating, from pixels of the at least one received scanline SL, a plurality of bundles B of a predetermined size. The size of the bundles B is chosen to be suitable for the second memory 200, and more in particular, for obtaining a high writing/reading data rate of the second memory. For example, the second memory may be a dynamic random access memory (DRAM), preferably a synchronous dynamic random access memory (SDRAM), and more preferably a DDR3 memory. For example, in order to obtain a data rate of 10240 megabits/second for DDR3 (with a clock of 320 MHz and a data bus of 16 bits), the size of the bundles has to be 512 bit, which corresponds with 128 pixels when each pixel is represented by 4 bits. Preferably, the predetermined size of a bundle B is chosen such that it is between 50% and 100% of an optimal size for writing and reading the second memory 200. So, for example for DDR3, preferably, the size of a bundle is between 64 and 128 pixels.

The logic unit 100 is configured for creating, from pixels of the at least one scanline SL, a plurality of bundles B, such that said plurality of bundles B comprises first bundles and consecutive bundles. The first bundles comprise pixels for which nozzles 350 of the inkjet device 300 have to be fired within a first time period. The consecutive bundles comprise pixels for which nozzles 350 of the inkjet device 300 have to be fired within a consecutive time period, after said first time period. The plurality of bundles B is temporarily stored in the first memory 110 before being transferred to the second memory 200. For example, when one scanline of 8000 pixels is received, 100 bundles of 80 pixels each may be created: 4 first bundles of 80 pixels each with pixels to be fired at a time t1, 4 consecutive bundles with pixels to be fired at a consecutive moment in time $t1+k\cdot\Delta t$, 4 consecutive bundles with pixels to be fired at a consecutive moment in time $t1+2k\cdot\Delta t$, . . . , wherein k is an integer corresponding to the number of scanlines between two rows, and wherein $\Delta t$ is the time between two consecutive firing instants. It is noted that this is a simplified example, and that e.g. the number of bundles with pixels to be fired at a particular moment in time can be different for different moments in time. For example, when three inkjet heads 310, 320, 330 are used as illustrated in FIG. 1, for the first scanline, more bundles will have to be created for pixels associated with inkjet heads 310, 330 than for inkjet head 320, which is shifted with respect to inkjet heads 310, 330. More generally, the mapping into bundles will depend on the arrangement of nozzles in the one or more inkjet heads as will be explained in more detail below.

The second memory 200 is configured for storing first and consecutive bundles of consecutive scanlines, until at least all pixels for which nozzles 350 of the inkjet device 300 have to be fired within the first time period are available in the second memory 200. For example, if each print head 310, 320, 330 has n rows, if the rows are separated by k scanlines, and if inkjet head 320 is shifted with respect to inkjet heads 310, 330 as in FIG. 1, then approximately $(2\times(n\times k))$ scanlines will have to be stored in the second memory 200 in order for all bundles with pixels to be fired within the first time period to be available in the second memory.

The printing system is further configured for firing nozzles 350 of the inkjet heads 310, 320, 330 in accordance with the first bundles within the first time period by reading the first bundles out of the second memory 200. Next, the nozzles are fired in accordance with the second bundles within the second time period by reading the second bundles out of the second memory 200, etc.

Preferably, the first memory 100 is at least 10 times smaller than the second memory 200, more preferably at least 100 times smaller than the second memory 200. For example, the first memory may be a memory configured to store less than 10 scanlines, whilst the second memory may be configured to store at least 2000 scanlines.

The logic unit 100 may be implemented in hardware or in software. For example, the logic unit 100 may be implemented as a programmable hardware component, preferably a field-programmable gate array (FPGA) or an ASIC. In another embodiment, the logic unit 100 may be a CPU provided with a small cache memory 110.

In a preferred embodiment, all pixels of a bundle are pixels which have to be fired at the same point in time. However, for certain inkjet heads, it may be advantageous to group pixels which have to be fired at different moments in time within the same time period, typically a small time period lower than 100 microseconds, preferably lower than 70 microseconds, and more preferably lower between 5 and 65 microseconds. Indeed, according to some printing methods there may be a small time difference between the firing of the nozzles instead of firing all nozzles simultaneously: in such a case it may be advantageous to group pixels that have to be fired within the same small time period in the same bundle.

For an inkjet head with n rows separated by k scanlines, the first bundles will comprise a subset of pixels of the first scanline, a subset of pixels of the $(k+1)^{th}$ scanline, a subset of pixels of the $(2k+1)^{th}$ scanline, . . . , and a subset of pixels of the $((n-1)k+1)^{th}$ scanline. Similarly, the second bundles will comprise a different subset pixels of the second scanline, a different subset of pixels of the $(k+2)^{th}$ scanline, a different subset of pixels of the $(2k+2)^{th}$ scanline, . . . , and a different subset of pixels of the $((n-1)k+2)^{th}$ scanline. Preferably, a bundle does not comprise pixels from different scanlines. However, in certain embodiments, it may be advantageous to group pixels of adjacent scanlines in the same bundle.

Figure 2:
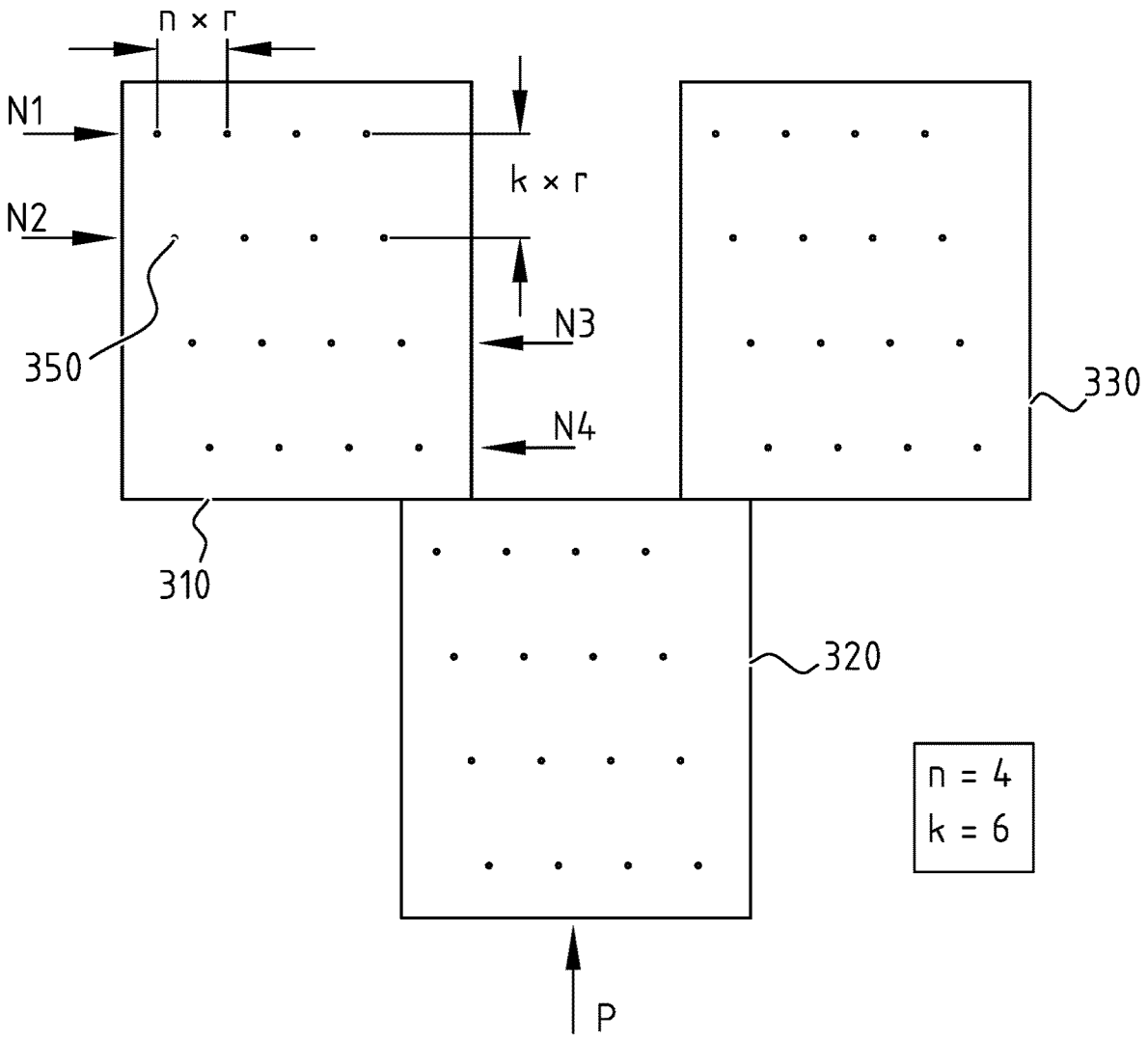
FIG. 2 illustrates schematically a simplified exemplary embodiment of three inkjet heads for use in a printing system or method.

FIG. 2 shows an example of an inkjet device 300 comprising three inkjet heads 310, 320, 330. Each inkjet head 310, 320, 330 comprises a plurality of rows N1, N2, etc., here four rows (n=4). Each row N1, N2, etc. has a plurality of m nozzles 350, here four nozzles (m=4). It is noted that in realistic embodiment of an inkjet head, the amount of rows and nozzles per row is typically much higher, e.g. between 16 and 32 rows, and between 100 and 400 nozzles per row. However, for explaining embodiments of the invention, the number of nozzles was reduced in order to not render the explanation overly complex. The rows N1, N2, etc. are oriented in a direction perpendicular to the printing direction P, i.e. in the direction in which the substrate moves below the inkjet heads 310, 320, 330. The distance between the centres of two adjacent nozzles 350 of a same row is n times the resolution r (distance between nozzles=n×r). The distance between adjacent nozzle rows is k times the resolution r (distance between nozzle rows=k×r).

The nozzle rows N1, N2, etc. are parallel and adjacent nozzle rows of the plurality of nozzle rows are shifted with respect to each other in a direction perpendicular on the printing direction P. In the illustrated embodiment row N2 is shifted over a distance r to the right with respect to row N1, row N3 is shifted over a distance r to the right with respect to row N2, and row N4 is shifted over a distance r to the right with respect to row N3. In other non-illustrated embodiments the shifting may be different, e.g. row N2 is shifted over a distance 2*r with respect to row N1, row N3 over a distance r with respect to row N1, and row N4 is shifted over a distance 3*r to the right with respect to row N3. The person skilled in the art understands that other variants are possible. Projected on a line perpendicular on the printing direction P, the centres of the nozzles are positioned at an equal distance of each other which corresponds to r.

During a typical printing process, the substrate is moved with a printing speed v and all (m×n×3) nozzles of the three inkjet heads 310, 320, 330 are fired substantially simultaneously with a firing frequency f=v/r. It is noted that there may be a small difference (order of nanoseconds) to avoid large power peaks, but such small differences will not be visible in the printed image. In other words, the firing frequency is such that each time the substrate has moved over a distance r, a firing of all nozzles of the inkjet heads 310, 320, 330 is performed. The rows are shifted with respect to each other such that the combination of dots printed during subsequent steps of the printing process form a regular pattern. More in particular, when the inkjet heads 310, 320, 330 have fired all (n×m×3) nozzles a number of times corresponding to 2k times the number of rows (n×k×2), while the substrate moves below the inkjet heads 310,

320, 330, one scanline extending perpendicular on the printing direction will be finished, and may comprise (n×m×3) pixels.

Figure 3:
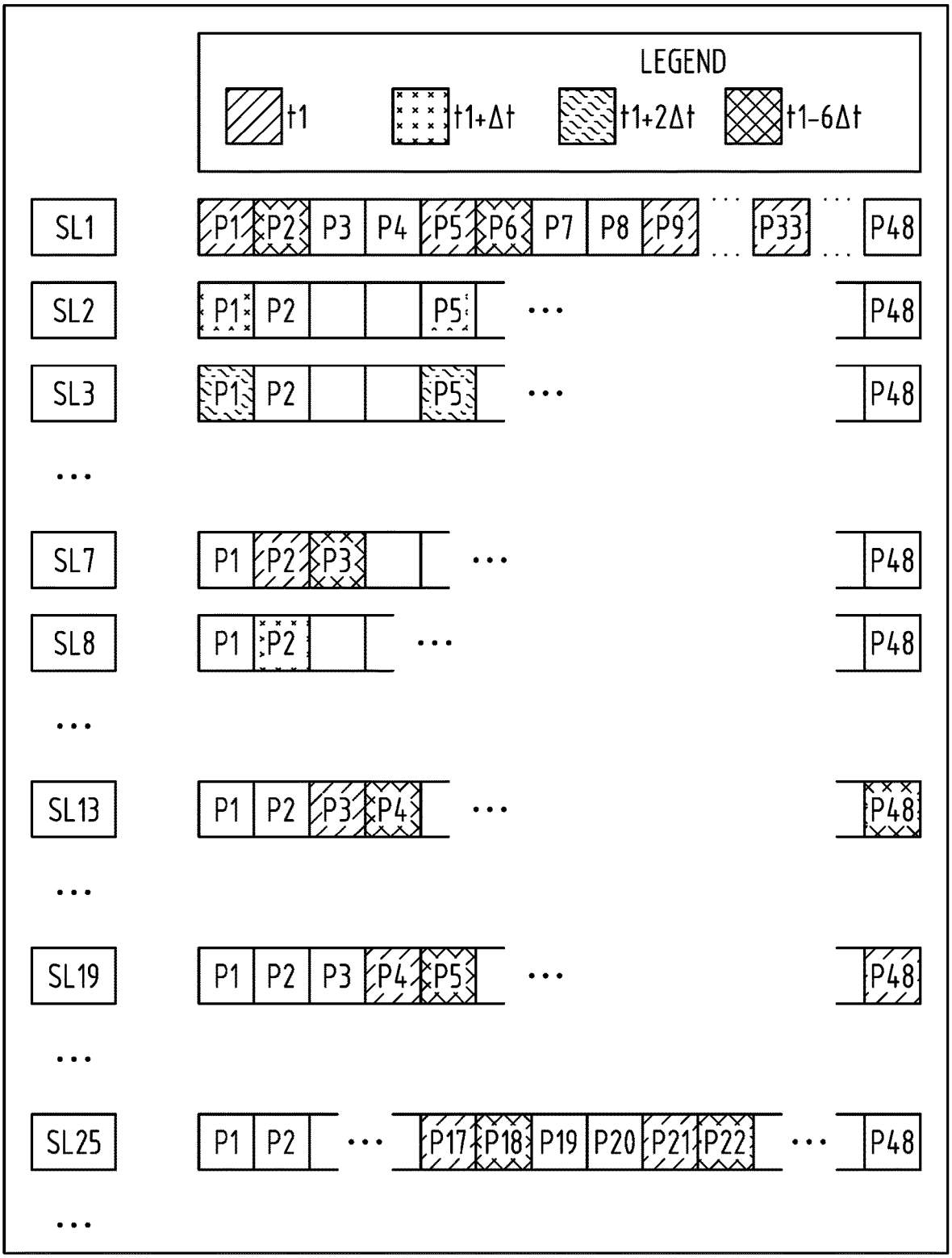
FIG. 3 is a schematic representation of a number of scanlines indicating moments in time at which pixels have to be printed.

Now an exemplary embodiment of a method for printing a plurality of scanlines SL with one or more inkjet heads will be explained with reference to FIG. 3. FIG. 3 is an example which corresponds with the three inkjet heads 310, 320, 330 illustrated in FIG. 2, wherein the number of rows of each head is four (n=4), the number of nozzles per row is 4 per head (m=4), and adjacent rows are separated by six scanlines (k=6). Each scanline SL comprises (n×m×3) pixels, i.e. 48 pixels indicated in FIG. 3 as P1, P2, P3, . . . , P48. In FIG. 2, it is assumed that the substrate runs from the bottom to the top as indicated with arrow P. It is further assumed that the substrate is at t1 in a position where the nozzles of row N1 print the first scanline SL1.

For the first scanline SL1, the first pixel P1 is fired at a first point in time t1 by the first nozzle of row N1, the second pixel P2 was fired 6 scanlines earlier (at t1−6Δt) by the first nozzle of row N2, the third pixel P3 was fired 12 scanlines earlier by the first nozzle of row N3 (at t1−12Δt), the fourth pixel P4 was fired 18 scanlines earlier by the first nozzle of row N4 (at t1−18Δt), the fifth pixel P5 is fired again at the first point in time t1, etc., wherein Δt is the time between two consecutive firing instants.

For the second scanline SL2, the first pixel P1 is fired at a second point in time t2 (=t1+Δt) by the first nozzle of the first row N1, the second pixel P2 was fired 6 scanlines earlier than t2 (at t2−6Δt) by the first nozzle of the second row N2, etc.

For the $(k+1)^{th}$ scanline SL7, the first pixel P1 has to be fired 6 scanlines after t1 (at t7=t1+6Δt), the second pixel P2 has to be fired at a first point in time t1 by the first nozzle of the second nozzle row N2, the third pixel P3 was fired 6 scanlines earlier (at t1−6Δt), etc.

Further, because the second inkjet head 320 is shifted with respect to the first and third inkjet heads 310, 33, scanlines SL25-SL48 will also comprise pixels to be printed at times t1, t2, t3, etc. More in particular, for scanline SL25 the $17^{th}$ pixel P17 has to be fired at time t1, and the $18^{th}$ pixel P18 will have to be fired at t1−6Δt, etc.

In other words, the following scanlines will comprise pixels to be printed

- at time t1: SL1, SL7, SL13, SL19, SL25, SL31, SL37, SL43;
- at time t2: SL2, SL8, SL14, SL20, SL26, SL32, SL38, SL44;
- at time t3: SL3, SL9, SL15, SL21, SL27, SL33, SL39, SL45;
- at time t4: SL4, SL10, SL16, SL22, SL28, SL34, SL40, SL46;
- at time t5: SL5, SL11, SL17, SL23, SL29, SL35, SL41, SL47;
- at time t6: SL6, SL12, SL18, SL24, SL30, SL36, SL42, SL48;
- at time t7: SL7, SL13, SL19, SL25, SL31, SL37, SL43;
- at time t8: SL8, SL14, SL20, SL26, SL32, SL38, SL44;
- at time t9: SL9, SL15, SL21, SL27, SL33, SL39, SL45;
- at time t10: SL10, SL16, SL22, SL28, SL34, SL40, SL46;
- at time t11: SL11, SL17, SL23, SL29, SL35, SL41, SL47;
- at time t12: SL12, SL18, SL24, SL30, SL36, SL42, SL48;
- etc.

wherein t2=t1+Δt, t3=t1+2Δt, t4=t1+3Δt, etc., wherein Δt is the time between two consecutive firing instants.

Figure 4:
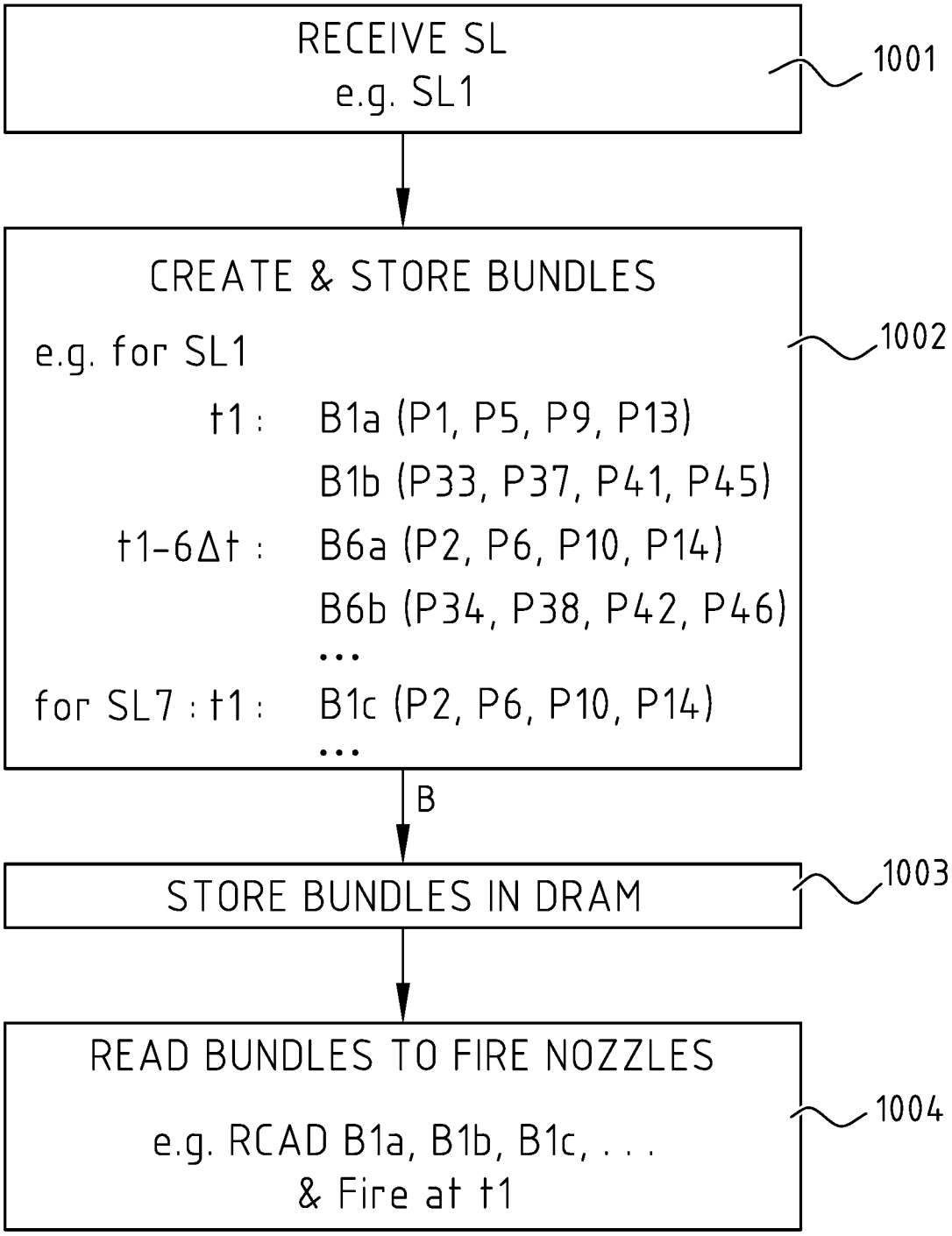
FIG. 4 is a flowchart illustrating an exemplary embodiment of a method for printing a plurality of scanlines.

FIG. 4 illustrates how the pixels of the scanlines of FIG. 3 may be bundled according to an exemplary embodiment of the method. In a first step 1001, at least one scanline is received. In the example it will be assumed that only one scanline at a time is received, but the skilled person will understand that it is also possible to receive e.g. two or three scanlines in parallel. First, the first scanline SL1 will be received. From the pixels P1-P48 of first scanline SL1, a plurality of bundles of a predetermined size is created. In the example, it will be assumed that bundles of four pixels are created, for reasons of simplicity. However, in realistic solutions, typically much bigger bundles will be created comprising e.g. between 70 and 128 pixels.

For scanline SL1 the following bundles are created:

- bundles to be fired at t1: B1a (P1, P5, P9, P13); B1b (P33, P37, P41, P45)
- bundles to be fired at (t1−6Δt): B6'a (P2, P6, P10, P14); B6'b (P34, P38, P42, P46)
- bundles to be fired at (t1−12Δt): B12'a (P3, P7, P11, P15); B12'b (P35, P39, P43, P47)
- bundles to be fired at (t1−18Δt): B18'a (P4, P8, P12, P16); B18'b (P36, P40, P44, P48)
- Pixels P17-P32 have to be printed even earlier by nozzles of second inkjet head 320 as will be understood by a person skilled in the art. For reasons of simplicity, the bundles corresponding with those pixels are not further detailed here.

For the second scanline SL2 the following bundles are created:

- bundles to be fired at t2 (=t1+Δt): B2a (P1, P5, P9, P13); B2b (P33, P37, P41, P45)
- bundles to be fired at (t2−6Δt=t1−5Δt): B5'a (P2, P6, P10, P14); B5'b (P34, P38, P42, P46)
- bundles to be fired at (t2−12Δt): B11'a (P3, P7, P11, P15); B11'b (P35, P39, P43, P47)
- bundles to be fired at (t2−18Δt): B17'a (P4, P8, P12, P16); B17'b (P36, P40, P44, P48)
- Pixels P17-P32 have to be printed even earlier by nozzles of second inkjet head 320 as will be understood by a person skilled in the art. For reasons of simplicity, the bundles corresponding with those pixels are not further detailed here.

For the $(k+1)^{th}$ scanline SL7, the following bundles may be formed:

- bundles to be fired at t7 (t7=t1+6Δt): B7a (P1, P5, P9, P13); B7b (P33, P37, P41, P45)
- bundles to be fired at t1: B1c (P2, P6, P10, P14); B1d (P34, P38, P42, P46)
- bundles to be fired at (t1−6Δt): B6'c (P3, P7, P11, P15); B6'd (P35, P39, P43, P47)
- etc.

Since the memory 110 of the logic unit is typically a small memory capable of storing only one or a couple of scanlines, the bundles are written into the second memory 200 before the first memory is full, and preferable before the next scanline arrives. So, after having created the bundles for the first scanline SL1, bundles B1a, B1b, B6'a, B6'b, B12'a, B12'b, etc. are written into the second memory 200, then the second scanline SL2 is grouped into bundles B2a, B2b, B5'a, B5'b, etc., and the bundles B2a, B2b, B5'a, B5'b, etc. are written in the second memory 200. These steps are repeated until all pixels for which nozzles of the inkjet heads 310, 320, 330 have to be fired at the first point in time t1 are available in the second memory. Since scanline SL43 is the last scanline containing pixels to be fired at the point in time t1, after having stored the bundles for scanline SL43 in the second memory 200, the nozzles of the inkjet heads 310, 320, 330 may be fired in accordance with the first bundles at the point in time t1. After scanline SL44 has been received, grouped in bundles, and stored in the second memory 200, the nozzles of the inkjet heads 310, 320, 330 may be fired in accordance with the second bundles B2a, B2b, etc. at the second point in time t2.

In FIG. 4, step 1002 illustrates the creating and storing of the bundles performed in logic unit 100, and step 1003 illustrates the storing of the created bundles in the second memory 200. In a following step 1004, the bundles to be fired at a particular point in time are read out of the second memory 200 and the nozzles of the inkjet heads 310, 320, 330 are fired accordingly.

Figure 5:
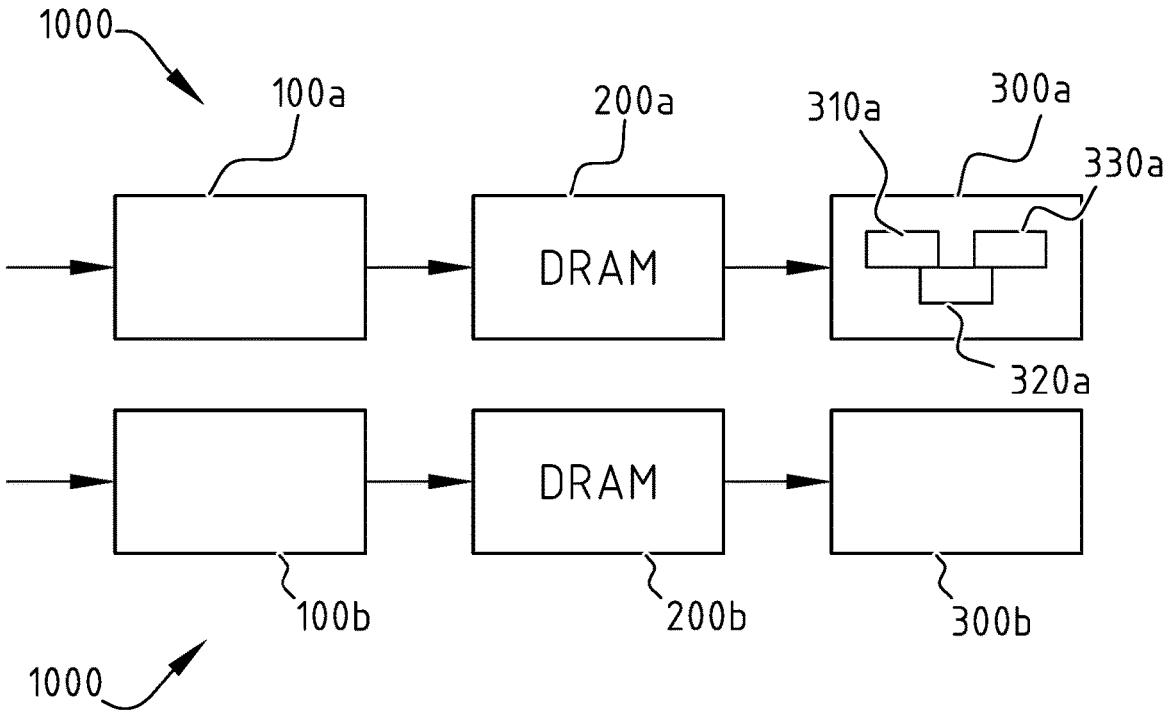
FIG. 5 illustrates schematically another exemplary embodiment of two printing systems combined in a single printer.

FIG. 5 illustrates that it is possible to combine two printing systems of the invention in a single printer. The inkjet devices 300*a*, 300*b* may be placed in series, and may each print half of the pixels of the scanlines to be printed. In this exemplary embodiment, there is provided a separate logic unit 100*a*, 100*b* and a separate second memory 200*a*, 200*b* for each inkjet device 300*a*, 300*b*.

Figure 6:
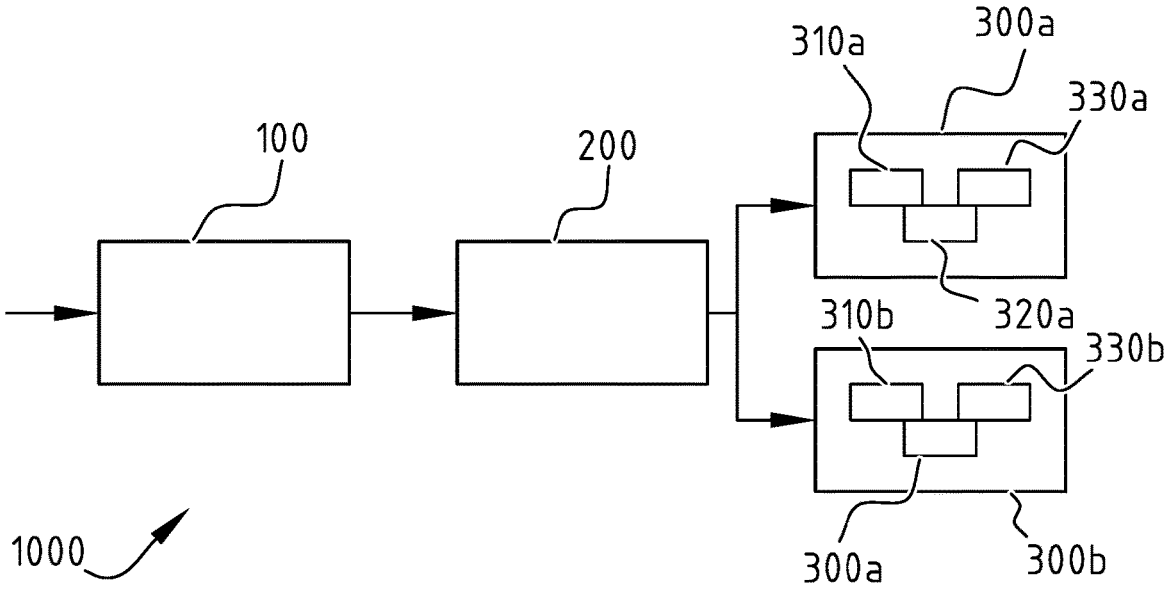
FIG. 6 illustrates schematically yet another exemplary embodiment of a printing system.

In another exemplary embodiment illustrated in FIG. 6, a single logic unit 100 and a single second memory 200 may be used for controlling two inkjet devices 300*a*, 300*b*, for example each comprising three inkjet heads 310*a*, 320*a*, 330*a*; 310*b*, 320*b*, 330*b*.

Figure 7:
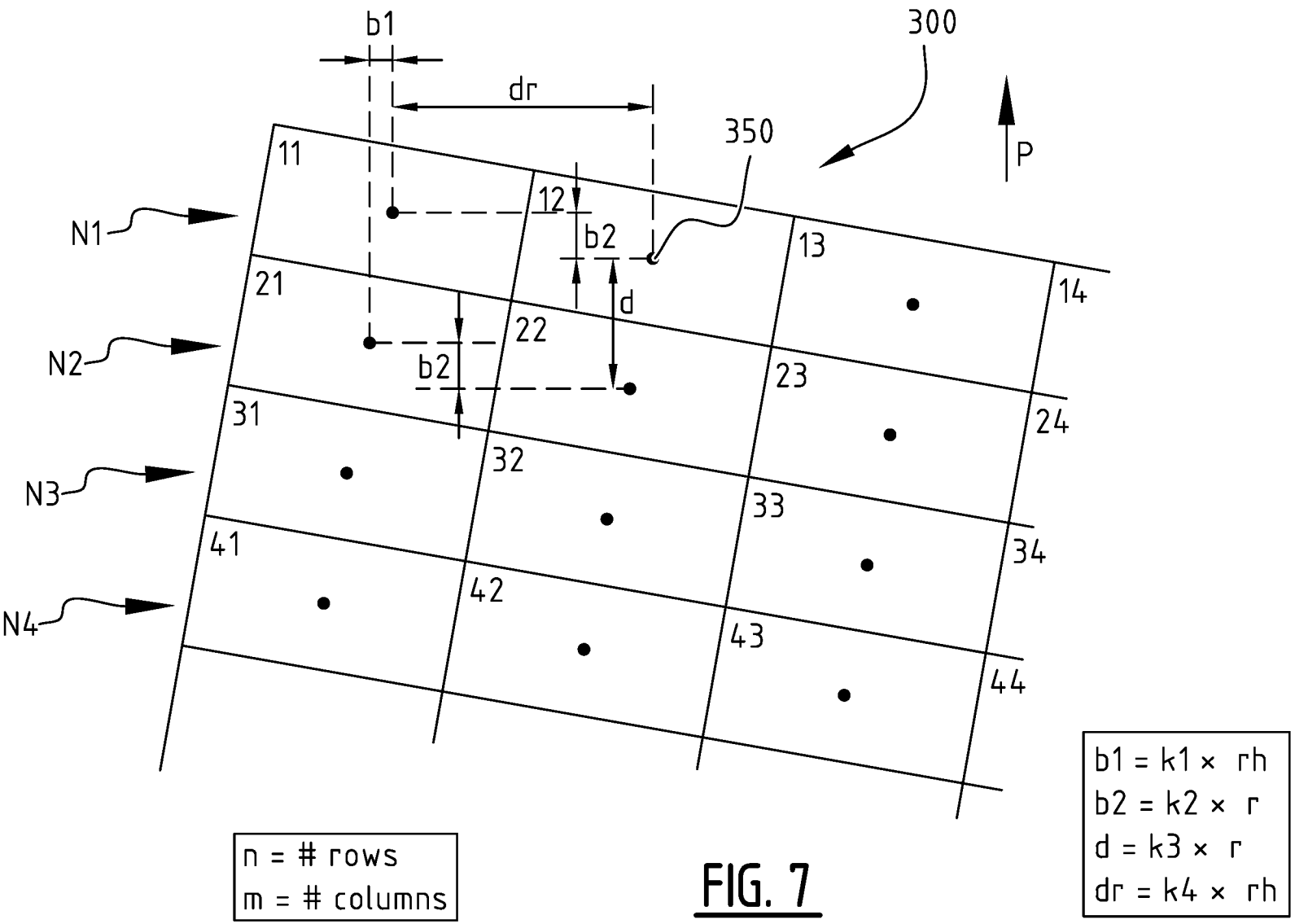
FIG. 7 illustrates another example of an inkjet head for use in an exemplary embodiment of the printing system or method.

Embodiments of the invention are also applicable in other types of inkjet heads. Another example of an inkjet head is illustrated in FIG. 7 and comprises a plurality of rows N1, N2, etc., e.g. 32 rows (n=32). Each row N1, N2, etc. comprises m nozzles, e.g. 64 nozzles (m=64). The nozzle rows are parallel and are directed under an angle between 60° and 89° with respect to the printing direction. The distance between the centres of two adjacent nozzles of a same row, when projected on a line perpendicular on the printing direction P is dr. dr is a multiple of the desired resolution rh seen in a horizontal direction perpendicular on the print direction (dr=k4*rh, wherein k4 is an integer). Adjacent nozzle rows of the plurality of nozzle rows are shifted with respect to each other in a direction perpendicular on the printing direction P over a distance b1. In the illustrated embodiment row N2 is shifted over a distance b1 to the left with respect to row N1, row N3 is shifted over a distance b1 to the left with respect to row N2, etc. The person skilled in the art understands that other variants are possible, similar to what has been explained above for FIG. 2. Projected on a line perpendicular on the printing direction P, the centres of the nozzles are positioned at an equal distance of each other which corresponds to b1. The distance between the centres of adjacent nozzles of a same row, projected on the printing direction, is b2. b1 is a multiple of the resolution rh in a direction perpendicular on the printing direction, i.e. b1=k1*rh, wherein k1 is an integer. b2 is a multiple of the resolution r in the printing direction, i.e. b2=k2*r, wherein k2 is an integer. A distance between adjacent nozzle rows, seen in the printing direction P, is d. Also d is a multiple of the desired resolution r seen in the printing direction (d=k3*r, wherein k3 is an integer). The substrate may be moved with a printing speed v and all m×n nozzles may be fired substantially simultaneously with a firing frequency f=k*v/d, wherein k is an integer. In other words, the firing frequency is such that each time the substrate has moved over a distance d/k a firing of all nozzles of the inkjet head is performed. The rows are shifted with respect to each other such that the combination of dots printed during subsequent steps of the printing process form a regular pattern.

Also for such an inkjet head, the creating of bundles as explained above in connection with FIG. 4 may be performed. In such embodiments, it may advantageous to combine pixels of adjacent scanlines in the same bundle, in order to make sure that the size of the bundles is sufficiently large.

Particular embodiments of the invention relate to the field of digital printing systems and methods for so-called "continuous" webs, i.e. printing systems where a continuous roll of substrate (e.g., paper, plastic foil, or a multi-layer combination thereof) is run through the printing station at a constant speed, in particular to print large numbers of copies of the same image(s), or alternatively, series of images, or even large sets of individually varying images.

The functions of the various elements shown in the figures, including any functional blocks labelled as "logic units", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "logic unit" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non volatile storage. Other hardware, conventional and/or custom, may also be included.

Whilst the principles of the invention have been set out above in connection with specific embodiments, it is to be understood that this description is merely made by way of example and not as a limitation of the scope of protection which is determined by the appended claims.

The invention claimed is:

1. A method for printing a plurality of scanlines with one or more inkjet heads; the method comprising:

a. receiving at least one scanline of the plurality of scanlines;

b. creating, from pixels of said at least one scanline, a plurality of bundles of a predetermined size, such that said plurality of bundles comprises first bundles and consecutive bundles, said first bundles and said consecutive bundles comprising pixels for which nozzles of the one or more inkjet heads have to be fired within a first time period and within a consecutive time period, respectively; and storing said plurality of bundles in a first memory; wherein the predetermined size of a bundle of the plurality of bundles is chosen in function of a second memory;

c. transferring said plurality of bundles from the first memory to the second memory;

d. repeating steps a-c until all pixels for which nozzles of the one or more inkjet heads have to be fired within the first time period are available in the second memory as the first bundles;

e. firing nozzles of the one or more inkjet heads in accordance with the first bundles within the first time period; and f. repeating steps d and e for consecutive bundles and associated respective consecutive time periods.

2. The method according to claim 1, wherein the second memory comprises a dynamic random-access memory (DRAM).

3. The method according to claim 1, wherein the predetermined size of a bundle of the plurality of bundles is between 50 and 100% of an optimal size for writing and reading the second memory.

4. The method according to claim 1, wherein each bundle comprises between 64 bits and 512 bits.

5. The method according to claim 1, wherein the first memory is at least 10 times smaller than the second memory.

6. The method according to claim 1, wherein the first memory stores less than 10 scanlines, and wherein the second memory stores at least 1000 scanlines.

7. The method according to claim 1, wherein the first memory is included in a programmable hardware component.

8. The method according to claim 1, wherein the first memory is a cache memory of a CPU.

9. The method according to claim 1, wherein the creating is done such that said first bundles and said consecutive bundles comprise pixels for which nozzles of the one or more inkjet heads have to be fired at a first moment in time and at a consecutive moment in time, respectively.

10. The method according to claim 1, wherein the plurality of scanlines comprises at least a first scanline, a (k+1)th scanline, and a (2k+1)th scanline, wherein k is an integer; wherein the creating is performed such that the first bundles comprise a subset of pixels of the first scanline, of the (k+1)th scanline, and of the (2k+1)th scanline and such that (k+1)th bundles comprise a different subset of pixels of the first scanline, the (k+1)th scanline, and the (2k+1)th scanline.

11. The method according to claim 1, wherein the one or more inkjet heads comprise a plurality of nozzle rows, wherein the grouping is performed such that all nozzles of each nozzle row to be fired within the first time period are covered by one or more first bundles and such that all nozzles of each nozzle row to be fired within the consecutive time period are covered by one or more consecutive bundles.

12. The method according to claim 1, wherein, during step a two or more adjacent scanlines are received, and wherein each bundle of the first bundles comprises pixels from the two or more adjacent scanlines, and wherein each bundle of the consecutive bundles comprises pixels from the two or more adjacent scanlines.

13. The method according to claim 1, wherein the first and consecutive time period are lower than 100 microseconds.

14. The method according to claim 1, wherein the one or more inkjet heads comprise a plurality of nozzle rows, and wherein the plurality of nozzle rows are directed perpendicular on the printing direction.

15. The method according to claim 1, wherein the one or more inkjet heads comprise a plurality of nozzle rows, wherein the plurality of nozzle rows are directed under an angle between 60° and 89° with respect to the printing direction.

16. A printing system for printing a plurality of scanlines, said system comprising:

one or more inkjet heads;

a logic unit configured for receiving at least one scanline, for creating, from pixels of said at least one scanline, a plurality of bundles of a predetermined size, such that said plurality of bundles comprises first bundles and consecutive bundles, said first bundles and said consecutive bundles comprising pixels for which nozzles of the one or more inkjet heads have to be fired within a first time period and within a consecutive time period, respectively, for storing said plurality of bundles in a first memory of the logic unit; and for transferring said plurality of bundles from the first memory to a second memory;

the second memory configured for storing bundles of consecutive scanlines, until at least all pixels for which nozzles of the one or more inkjet heads have to be fired within the first time period are available in the second memory;

wherein the predetermined size of a bundle of the plurality of bundles is associated with the second memory; and wherein the printing system is configured for firing nozzles of the one or more inkjet heads in accordance with the first bundles within the first time period by reading the first bundles out of the second memory; and in accordance with consecutive bundles within the associated consecutive time period by reading the consecutive bundles out of the second memory.

17. The system according to claim 16, wherein the second memory comprises a dynamic random-access memory (DRAM).

18. The system according to claim 16, wherein the predetermined size of a bundle of the plurality of bundles is between 50 and 100% of an optimal size for writing and reading the second memory; and wherein each bundle comprises between 16 and 128 pixels.

19. The system according to claim 16, wherein the creating is done such that said first bundles and said consecutive bundles comprise pixels for which nozzles of the one or more inkjet heads have to be fired at a first moment in time and at a consecutive moment in time, respectively.

20. A method for printing a plurality of scanlines with one or more inkjet heads; the method comprising:

a. receiving at least one scanline of the plurality of scanlines;

b. creating, from pixels of said at least one scanline, a plurality of bundles of a predetermined size, such that said plurality of bundles comprises first bundles and consecutive bundles, said first bundles and said consecutive bundles comprising pixels for which nozzles of the one or more inkjet heads have to be fired within a first time period and within a consecutive time period, respectively; and storing said plurality of bundles in a first memory; wherein the predetermined size of a bundle of the plurality of bundles is chosen in function of a second memory;

c. transferring said plurality of bundles from the first memory to the second memory;

d. repeating steps a-c until all pixels for which nozzles of the one or more inkjet heads have to be fired within the first time period are available in the second memory as the first bundles;

e. firing nozzles of the one or more inkjet heads in accordance with the first bundles within the first time period; and f. repeating steps d and e for consecutive bundles and associated respective consecutive time periods, wherein the second memory comprises a dynamic random-access memory (DRAM), and wherein the first memory is at least 10 times smaller than the second memory.

* * * * *